US008482423B2

(12) United States Patent
Jonsson

(10) Patent No.: US 8,482,423 B2
(45) Date of Patent: Jul. 9, 2013

(54) GROUND TERMINAL BLOCK FAULT INDICATOR

(75) Inventor: Hilmir Ingi Jonsson, Grindavik (IS)

(73) Assignee: Remake Electric ehf., Kopavogur (IS)

( * ) Notice: Subject to any disclaimer, the term of this patent is extended or adjusted under 35 U.S.C. 154(b) by 301 days.

(21) Appl. No.: 12/742,019

(22) PCT Filed: Nov. 10, 2008

(86) PCT No.: PCT/IS2008/000019

§ 371 (c)(1),
(2), (4) Date: Jul. 21, 2010

(87) PCT Pub. No.: WO2009/060474

PCT Pub. Date: May 14, 2009

(65) Prior Publication Data

US 2010/0295693 A1 Nov. 25, 2010

(30) Foreign Application Priority Data

Nov. 9, 2007 (IS) ..... 8689

(51) Int. Cl.
*G08B 21/00* (2006.01)

(52) U.S. Cl.
USPC ..... 340/651; 340/664

(58) Field of Classification Search
USPC ..... 340/651, 652, 641, 657, 664, 644, 340/815.4, 815.45; 439/92, 94, 716
See application file for complete search history.

(56) References Cited

U.S. PATENT DOCUMENTS

| | | | | |
|---|---|---|---|---|
| 3,508,257 | A | 4/1970 | Grogan | |
| 5,022,873 | A | 6/1991 | Koellmann | |
| 5,928,008 | A | 7/1999 | Munshi | |
| 7,167,348 | B2 * | 1/2007 | Knox et al. | 361/23 |

FOREIGN PATENT DOCUMENTS

| | | |
|---|---|---|
| GB | 1 591 058 | 11/2007 |

* cited by examiner

*Primary Examiner* — Toan N Pham
(74) *Attorney, Agent, or Firm* — Muncy, Geissler, Olds & Lowe, PLLC

(57) ABSTRACT

An electrical ground terminal block assembly and arrangement to make ground fault situation accessible comprise a ground terminal housing to hold the wire linking elements and a characterized ground fault indicating device. The ground terminal block based on the invention is comprised with signalling means to indicate ground fault. Fault current is detected by the ground fault indicating device through upper linking element detection device of said ground terminal block.

18 Claims, 2 Drawing Sheets

GROUND TERMINAL BLOCK FAULT INDICATOR

FIELD OF INVENTION

The present invention relates generally to the field of electrical terminal equipment more particularly to ground terminal block assemblies.

BACKGROUND OF THE INVENTION

Ground terminal blocks have been used to link separate wires to the DIN rail by using a metal clamping bar. Ground terminal blocks also link separate wires for ground connection by internal connection, but are not equipped with metal clamps. The main purpose with terminal blocks is to make electrical connections accessible. Terminal blocks have been equipped with a LED or an array of LEDs to show active current, operational status of a device and/or fault mode detection of a device. Ground terminal blocks have been used to connect separate wires to ground internally or through the DIN rail with a metal clamping bar to cause a connected residual current circuit breaker or a ground fault interrupter to trip when fault current is connected to ground. This function protects against electrical shock and damage to appliances or devices. Ground terminal blocks are essential elements in ground connections in panel boards. When ground terminal blocks are used in panel boards the ground wiring is made very accessible and saves time and cost in both assembly and maintenance.

Ground terminal blocks can deliver fault current to a residual current circuit breaker or a ground fault interrupter causing it to trip. However, when the electricity power is out it is impossible to locate the source of the fault current in the panel board. Terminal blocks other than ground terminal blocks have been equipped with a LED to show active current, operational status of a device and fault mode detection of a device but the LED will not be lighted when the power is out also the LED will not indicate either the ground fault current or the source of the fault. When ground fault current occurs and the electrical power goes out it is not possible to turn electrical power back on until the source of the ground fault current has been established and eliminated. This composes a problem because the circuit breaker carrying the fault current will in most cases not trip along with the residual current circuit breaker or ground fault interrupter. Consequently the source of the problem is not accessible since only the residual current circuit breaker or the ground fault interrupter is tripped and electrical power is out. As a result it can be very hard for professionals to track the source and almost impossible for novice to resolve. This can be very time and financially costly even though the source of the problem is not always very serious. In ground fault current situations it can take a professional electrician some time before finding the fault because of the electrical power out. Traditional ground terminal blocks can be very useful during ground fault tracking hence the accessible wire disconnection but traditional ground terminal blocks cannot indicate ground fault current in any way.

SUMMARY OF THE INVENTION

A solution of the problem stated above is found by the present invention by combining a ground terminal block with a device which ignites a LED when ground fault is detected and holds the LED lighted after electrical power is out. A detection means is placed inside a ground terminal block linking wires from the upper connection element of the ground block to the device wherefrom the lower connection element is linked to a DIN rail making ground connection able. The device will ignite a LED when connected with ground fault current making the fault source very accessible. The device will not ignite the LED when ground fault current is detected from the lower connection element ensuring only the ground block which the fault current passed through from upper connection will be lighted. This will ensure that when approaching electrical power out situations the ground terminal block causing the power out will be the only ground terminal block lighted. The invention can also be equipped to make a signal sound in ground fault situations alerting the fault source. This will make ground fault current problem finding very accessible and easy to resolve. The objective with the invention is mainly to make ground fault current situations accessible for professionals and normal users. Another objective is to make ground fault current problem tracking simpler and faster by lighting a LED on the ground terminal to indicate the problems source saving both time and money.

The present invention relates to a ground terminal block with a fault indicator used to mechanically and electrically link wires to ground connection. The linkage is provided through an internal metal clamping bar fastened on a DIN rail by means of a fastening element on the back of the invention and by linking wires to ground connection as an internal feed through device. The ground terminal block is arranged with a metal clamping bar where the lower linking part of the clamping bar is not connected directly to the upper wire connection element of the ground block. The upper wire connection element is linked directly to a ground fault indicating/signalling device before linking to the lower wire connection element and the clamping bars lower linking part connected to the DIN rail. The ground terminal block is installed with a signalling device, such as a light emitting diode (LED), which will light up when ground fault current occur. When a fault current flows through a single ground block from the upper connection of the ground block to the ground fault detection device, a LED is ignited indicating the ground fault and there from to the lower connection of the ground block, which is connected to the DIN rail. The LED is controlled by the inventions ground fault detection device. The new detection and signalling means of the present invention is used as a part of a ground terminal block wire feed through arrangement connecting separate wires to ground connection in panel boards or direct connection to a DIN rail.

The advantageous effect of the present invention is the use of a maintained signal light, when a ground fault current situation has occurred and electrical power is out saving fault finding time and cost. Another effect is the signal sound alerting the source of the problem.

In a first aspect of the present invention a ground terminal block is provided, comprising a housing, a first and a second wire connection (inlets), a first and a second linking element, connected to the respective first and a second wire connection, and a clamping device. The clamping device is connected to the second linking element. The present invention is characterized in that the ground terminal block further comprises a fault detecting device connected to the first linking element and to the clamping device.

In a second aspect of the present invention a system is provided for making ground current fault source accessible in a ground terminal block using the ground terminal block of the present invention.

DESCRIPTION

The ground terminal block of the present invention is used in combination with residual current circuit breakers or ground fault interrupters. Fault current from electrical machines or appliances to the DIN rail or to a ground connection flowing through the invention will cause the residual current circuit breaker or the ground fault interrupter to trip causing electrical power out. In low fault current situations where fault current is not sufficient to trip the residual current circuit breaker or the ground fault interrupter the inventions indicating LED can be arranged to be lighted is a specific color to indicate low fault current. When the ground terminal block of the present invention is connected in series with more ground blocks the ground fault detection means will not let a fault current flowing from the lower connection of a single ground block ignite the ground fault indicating LED in other ground blocks. The ground fault detecting device is a switching device in the sense that it is arranged so that when a fault current passes through the device it will switch on a LED and/or initiates an acoustic signal, but only when the fault current passes from the upper connection element to the device. The device will only switch the LED and signal sound on and off, but always keep constant and direct contact through the ground terminal block. The device will not ignite the LED when fault current passes from the lower connection ensuring that when fault current is detected only the ground block which the fault current passed through will be ignited. The LED will continue lighting after the residual current circuit breaker or the ground fault interrupter has tripped and electrical power is out indicating and making accessible the source of ground fault. The indicating fault LED can be illuminable in various colors to indicate for example the strength of the fault current. The invention can also be equipped with a signal sound. The signal sound will alert the ground fault and make the invention more accessible when electrical power is out. The invention is not restricted to shape or form of the ground terminal block shown in the drawings but relates to all types of ground terminal blocks known in the art.

In an embodiment of the present invention the fault detecting device is attached to a signalling means, such as an acoustic signalling means or a light signalling means. The light signalling means may display various colours for ground fault strength indication. The light signalling means according to the present invention may further comprise at least one light emitting diode (LED) to identify source of ground fault and the signalling LED is located and accessible wherever on the front of said housing. According to an embodiment the present invention the signalling means is activated to indicate low fault current without tripping the electrical power.

In an embodiment of the present invention the ground terminal block further comprises means for maintaining signalling after fault has occurred. This means can be selected from, but not limited to condensers or batteries.

In an embodiment of the present invention the housing of the ground terminal block is shaped in the form of a standard size of a ground terminal block, where one side of the housing is attachable to a DIN rail.

In an embodiment of the present invention the ground fault detecting device is DIN rail connected from upper or the lower linking element.

In an embodiment of the present invention the ground terminal block is a multi terminal block unit where phase, neutral and ground wires are linked separately in single terminal block housing.

DESCRIPTION OF DRAWINGS

FIG. 1 discloses the front view of a ground terminal block showing an upper having an upper (3) and lower (7) wire connection or inlet. Wires are fastened and linked to the ground terminal block by upper (8) and lower (9) fastening screw or plug-in connections providing ground connection through a clamping bar. Signalling means (11) is shown in the front side of the housing of the ground terminal block, which is in this specific embodiment a light emitting diode (11).

FIG. 2 shows a side view of the ground terminal block disclosing the functional components of the device supported by the housing (1). The ground terminal block comprises a detection device (2) and is fastened on a DIN rail by a clamping bar (4). An upper wire connection (3) is connected to the upper linking element (5) linking the upper wire connection (3) and the detection device (2). The detection device (2) is connected to the clamping bars (4), which is further connected to the lower linking element (6) joined with the lower wire connection (7). Wires are fastened and linked to ground terminal block by upper (8) and lower (9) fastening screw or plug-in connections allowing ground connection through the clamping bar (4), which is fastened on a DIN rail by the inventions fastening element (10). The fault detection device (2), shown in this embodiment is equipped with a light emitting diode (11) which indicates ground fault current.

Figure 1:
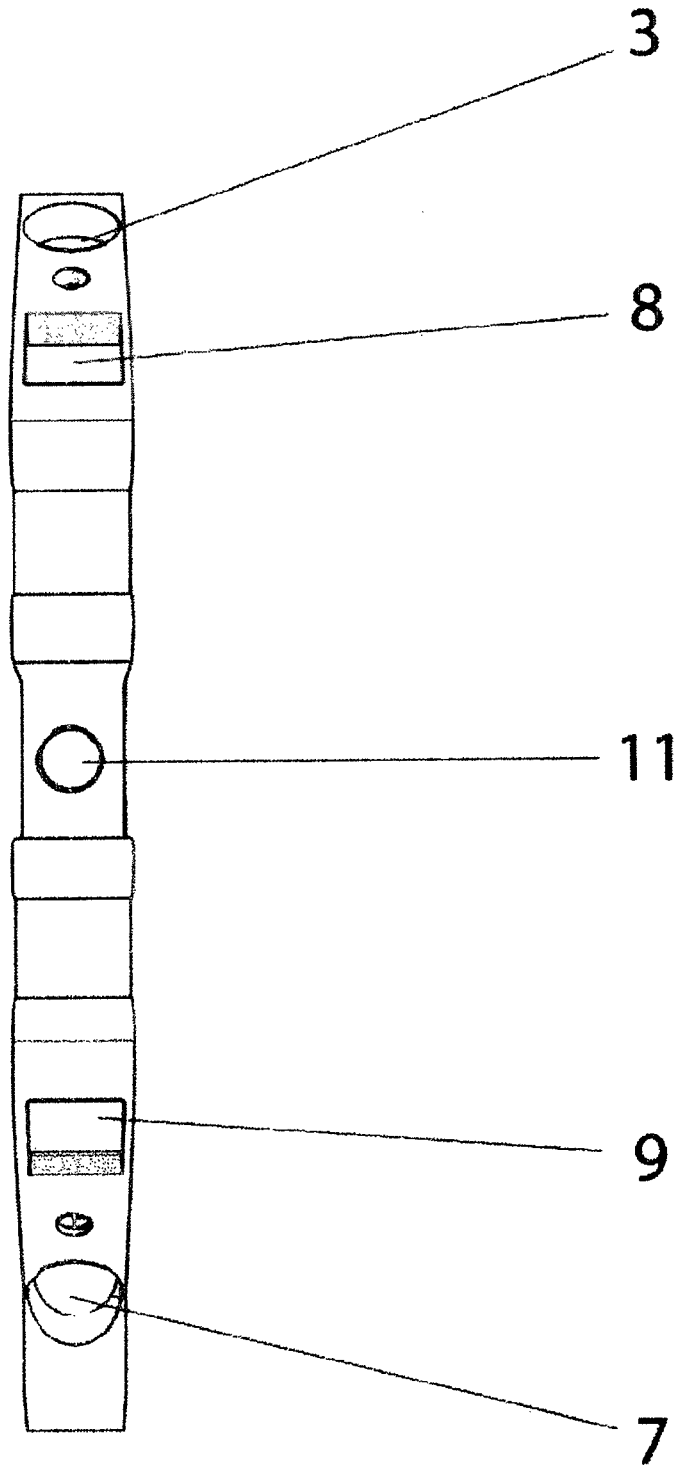
FIG. 1 shows the front viewpoint of an embodiment of the ground terminal block of the present invention.
Figure 2:
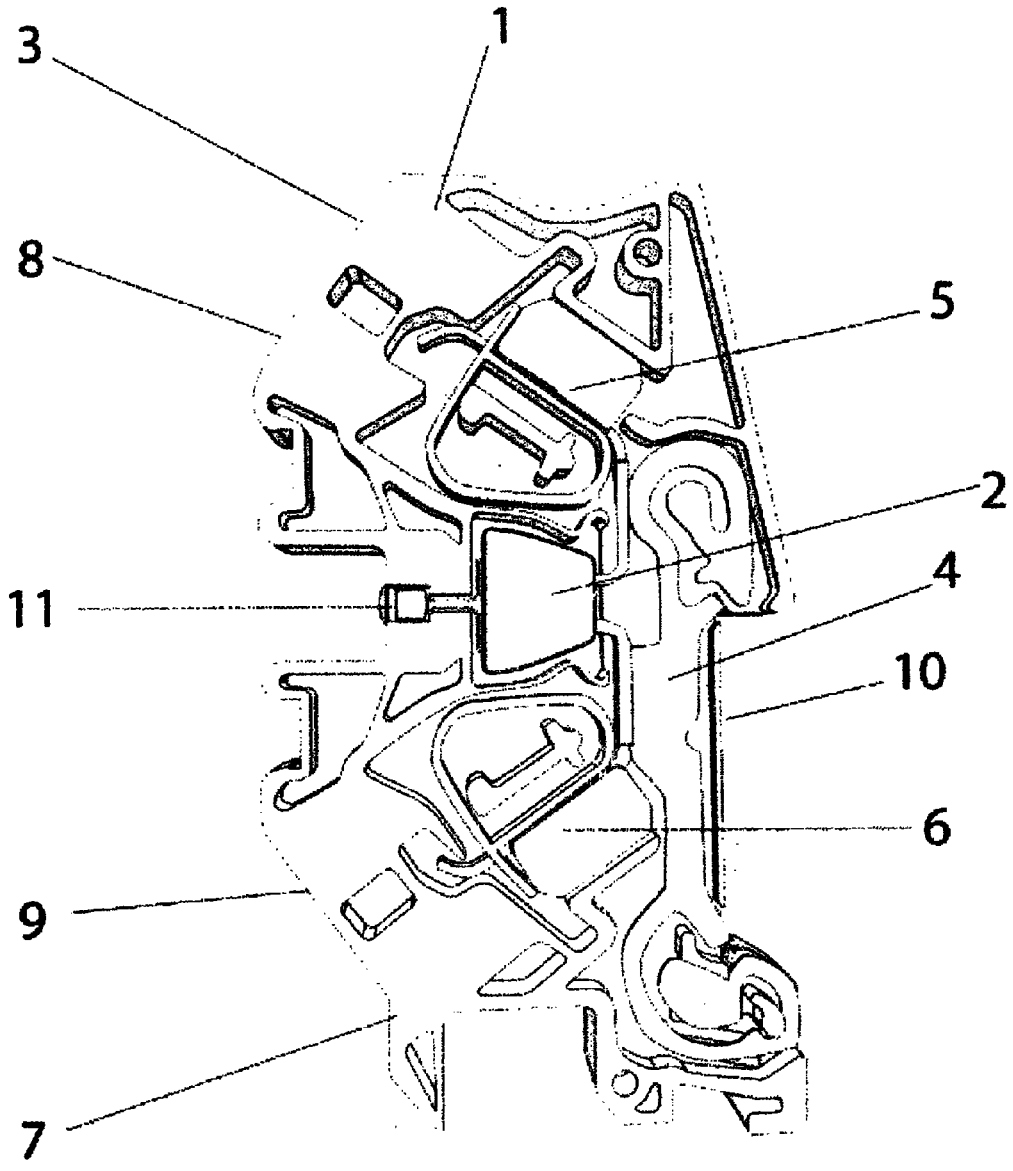
FIG. 2 shows the side viewpoint of the embodiment of the ground terminal block of the present invention of FIG. 1

What is claimed is:

1. A ground terminal block, comprising:

a housing, a first and a second wire connection, a first and a second linking element, connected to the respective first and a second wire connection, an internal metal clamping device, connected to the second linking element, wherein the ground terminal block further comprises a fault detecting device connected to the first linking element and to the clamping device, and wherein a lower part of the internal metal clamping device is connected to a DIN rail.

2. The ground terminal block according to claim 1, wherein the fault detecting device is connected to a signaling means.

3. The ground terminal block according to claim 2, wherein the signaling means is an acoustic signaling means.

4. The ground terminal block according to claim 2, wherein the signaling means is a light signaling means.

5. The ground terminal block according to claim 4, wherein the light signaling means displays various colours for ground fault strength indication.

6. The ground terminal block of claim 4, wherein the light signaling means comprises at least one light emitting diode (LED) to identify source of ground fault.

7. The ground terminal block according to claim 4, wherein the light signaling means is located and accessible on the front of said housing.

8. The ground terminal block according to claim 2, wherein the signaling means is activated to indicate low fault current without tripping the electrical power.

9. The ground terminal block according to claim 2, wherein an upper one of said first and said second wire connection is linked directly to said signaling means.

10. The ground terminal block according to claim 1, wherein the ground terminal block further comprises a means for maintaining signaling after fault has occurred.

11. The ground terminal block according to claim 1, wherein the housing is shaped in the form of a standard size of a ground terminal block.

12. The ground terminal block according to claim 1, wherein one side of the housing is attachable to the DIN rail.

13. The ground terminal block according to claim 1, wherein the ground fault detecting device is DIN rail connected from an upper linking element.

14. The ground terminal block according to claim 1, wherein the ground fault detecting device is DIN rail connected from a lower linking element.

15. The ground terminal block according to claim 1, wherein the ground terminal block is a multi terminal block unit where phase, neutral and ground wires are linked separately in a single terminal block housing.

16. The ground terminal block according to claim 1, wherein the internal metal clamping device is attached directly to the DIN rail.

17. The ground terminal block according to claim 1, wherein the connection of the internal metal clamping device to the DIN rail creates a ground connection.

18. A system for making ground current fault source accessible in a ground terminal block according to claim 1.

* * * * *